US006176451B1

(12) United States Patent
Drymon

(10) Patent No.: US 6,176,451 B1
(45) Date of Patent: Jan. 23, 2001

(54) UTILIZING HIGH ALTITUDE LONG ENDURANCE UNMANNED AIRBORNE VEHICLE TECHNOLOGY FOR AIRBORNE SPACE LIFT RANGE SUPPORT

(75) Inventor: Thomas S. Drymon, Santa Maria, CA (US)

(73) Assignee: Lockheed Martin Corporation

( * ) Notice: Under 35 U.S.C. 154(b), the term of this patent shall be extended for 0 days.

(21) Appl. No.: 09/157,550

(22) Filed: Sep. 21, 1998

(51) Int. Cl.[7] ..... F41G 7/00

(52) U.S. Cl. ..... 244/3.14; 244/3.11; 244/158 R; 244/172; 701/2; 701/3; 342/52; 342/58; 342/60; 342/62

(58) Field of Search ..... 244/3.1, 3.11, 244/3.14, 3.15, 3.19, 158 R, 160, 162, 3.12, 172; 342/13, 52–58, 60, 62, 61, 63; 701/1–8

(56) References Cited

U.S. PATENT DOCUMENTS

| | | | | |
|---|---|---|---|---|
| 3,778,007 | * | 12/1973 | Kearney, II et al. | 244/3.14 |
| 4,043,524 | | 8/1977 | Dreyer et al. . | |
| 4,044,974 | | 8/1977 | Lingley et al. . | |
| 4,082,240 | | 4/1978 | Heathman et al. . | |
| 4,232,313 | | 11/1980 | Fleishman . | |
| 4,240,601 | * | 12/1980 | Reed | 244/160 |
| 4,265,416 | | 5/1981 | Jackson et al. . | |
| 4,386,355 | | 5/1983 | Drew et al. . | |
| 4,471,926 | | 9/1984 | Steel, III . | |
| 4,562,441 | | 12/1985 | Beretta et al. . | |
| 4,575,029 | | 3/1986 | Harwood et al. . | |
| 4,726,224 | | 2/1988 | D'Ausilio . | |
| 4,802,639 | | 2/1989 | Hardy et al. . | |
| 4,834,531 | | 5/1989 | Ward . | |
| 4,880,187 | | 11/1989 | Rourke et al. . | |
| 4,884,770 | | 12/1989 | Martin . | |
| 4,896,848 | | 1/1990 | Ballard et al. . | |
| 4,901,949 | | 2/1990 | Elias . | |
| 4,943,014 | | 7/1990 | Harwood et al. . | |
| 4,964,340 | | 10/1990 | Daniels et al. . | |
| 5,040,748 | | 8/1991 | Torre et al. . | |
| 5,064,151 | | 11/1991 | Cerimele et al. . | |
| 5,074,489 | | 12/1991 | Gamzon . | |
| 5,090,642 | | 2/1992 | Salkeld . | |
| 5,099,245 | | 3/1992 | Sagey . | |
| 5,129,602 | | 7/1992 | Leonard . | |
| 5,141,181 | | 8/1992 | Leonard . | |
| 5,143,327 | | 9/1992 | Martin . | |
| 5,143,328 | | 9/1992 | Leonard . | |
| 5,186,414 | * | 2/1993 | Holzschuh et al. | 244/3.12 |
| 5,186,419 | | 2/1993 | Scott . | |
| 5,217,187 | | 6/1993 | Criswell . | |
| 5,217,188 | | 6/1993 | Thole et al. . | |
| 5,225,842 | | 7/1993 | Brown et al. . | |
| 5,242,135 | | 9/1993 | Scott . | |
| 5,255,873 | | 10/1993 | Nelson . | |
| 5,295,642 | | 3/1994 | Palmer . | |
| 5,322,248 | | 6/1994 | Ragab . | |
| 5,350,138 | | 9/1994 | Culbertson et al. . | |
| 5,402,965 | | 4/1995 | Cervisi et al . | |
| 5,456,424 | | 10/1995 | Palmer . | |
| 5,521,817 | * | 5/1996 | Burdoin et al. | 701/3 |
| 5,564,648 | | 10/1996 | Palmer . | |
| 5,568,901 | | 10/1996 | Stiennon . | |
| 5,581,462 | | 12/1996 | Rogers . | |
| 5,589,834 | | 12/1996 | Weinberg . | |

(List continued on next page.)

*Primary Examiner*—Bernarr E. Gregory
(74) *Attorney, Agent, or Firm*—Kenneth W. Float

(57) ABSTRACT

A mobile space lift range system using a ground control station and an unmanned airborne vehicle that relayed data to and from a space lift vehicle to control it. The unmanned airborne vehicle may selectively include one or more sensor systems, a radar system, a command and telemetry system, and a user test system. The unmanned airborne vehicle is a high attitude, long endurance vehicle that provides a flexible, mobile range to support launch-anywhere space lift scenarios.

13 Claims, 2 Drawing Sheets

U.S. PATENT DOCUMENTS

| | | | |
|---|---|---|---|
| 5,626,310 | 5/1997 | Kelly . | |
| 5,666,648 | 9/1997 | Stuart . | |
| 5,667,167 | 9/1997 | Kistler . | |
| 5,678,784 | 10/1997 | Marshall, Jr. et al . | |
| 5,716,032 | 2/1998 | Mclngvale . | |
| 5,739,787 | 4/1998 | Burke et al . | |
| 5,740,985 | 4/1998 | Scott . | |
| 5,799,902 | 9/1998 | Keith et al. . | |
| 5,855,339 * | 1/1999 | Mead et al. | 244/3.11 |

* cited by examiner

UTILIZING HIGH ALTITUDE LONG ENDURANCE UNMANNED AIRBORNE VEHICLE TECHNOLOGY FOR AIRBORNE SPACE LIFT RANGE SUPPORT

BACKGROUND

The present invention relates generally to space lift ranges, and more particularly, to a space lift system comprising an unmanned airborne vehicle that is used to implement a mobile space lift range.

Conventional space lift ranges for use in support of lifting payloads into space utilizing rockets and similar vehicles have been either ground based or space based. Ground-based space lift ranges are restrictive in that only specific predefined range layouts can be used due to range limitations that are required to exist between the ground control station and the space lift vehicle. Space-based space lift ranges are expensive since satellite links are required to communicate with the space lift vehicle. Recently deployed launch vehicles and concepts are more mobile than traditional systems. The Russians are offering Low Earth Orbit (LEO) services from Nuclear Submarines and the U.S. Navy is launching from sea-borne platforms. Pegasus and VentureStar can be launched from practically anywhere. Conversely, range systems have remained fixed requiring mobile launchers to travel to the range to acquire range services.

Heretofore, there have been no mobile space lift ranges for use in support of lifting payloads into space. Furthermore, no mobile space lift range has heretofore been developed that uses an unmanned airborne vehicle as a means to communicate with a space lift vehicle.

It would therefore be desirable to have a mobile space lift range that uses an unmanned airborne vehicle that provides flexibility when compared to conventional space lift ranges.

SUMMARY OF THE INVENTION

The present invention provides for an architectural approach for a mobile space lift range system that utilizes a high attitude, long endurance, unmanned airborne vehicle to provide a mobile space lift range. The present system extends traditional the use of unmanned airborne vehicle technology to provide a flexible, mobile range to support launch-anywhere space lift scenarios.

The unmanned airborne vehicle is a high attitude, long endurance airborne platform that provides a fully reusable aeronautical vehicle designed to serve as a global stratospheric low-cost airborne mission payload platform. The unmanned airborne vehicle or airborne payload platform is designed for operational use at altitudes between about 15 and 30 kilometers. The unmanned airborne vehicle is also designed to provide airborne operation for days, weeks, or longer, depending upon operational requirements.

More particularly, the mobile lift range system comprises a ground control station and an unmanned airborne vehicle that is used to relay data to and from a space lift vehicle such as a rocket, for example. The unmanned airborne vehicle in accordance with the present invention includes a variety of systems including one or more sensor systems, a radar system, a telemetry and command system, and a user test system.

The use of an unmanned airborne vehicle to implement the present mobile space lift range system has several advantages as a platform for space lift range applications. These advantages include long on-station endurance, very high altitude operation capability, the unmanned airborne vehicle may be deployed across vast geographic expanses, the unmanned airborne vehicle is responsive to real-time redirection and the solution is more cost effective than either traditional ground-based ranges or space-based ranges. These advantages allow the range to be virtual rather than fixed, resulting in maximum flexibility.

The unmanned airborne vehicle can support both orbital and sub-orbital missions. In addition, the unmanned airborne vehicles has a simple design with no egress systems, minimum avionics, fundamental or no hydraulics, and is lightweight, resulting in reduced airframe load and stress. Engines for the unmanned airborne vehicle are designed for lower loads and can easily be repaired or simply replaced at preset intervals. These unique capabilities are realized with the added advantage of programmable autonomous operation, eliminating the cost of a pilot and crew.

Unmanned airborne vehicles are cost efficient compared to both satellite (space-based) systems and ground-based systems. Also, the unmanned airborne vehicles are reusable with regular payload servicing and may be readily enhanced as technology improves. The unmanned airborne vehicle operates at a fraction of the orbital distance of low earth orbiting satellites, and as mentioned above, offers advantages that implement flexible and cost effective space lift range applications. The unique combination of altitude, endurance and selective payload enables a variety of interesting missions to be implemented that are not achievable using conventional space-based and ground-based systems.

Unmanned airborne vehicles employed in the present system are operationally feasible and economical, and fill a distinct niche as a low cost alternative technology for use in lieu of small satellite low earth orbit (LEO) space systems and manned aeronautical or terrestrial systems. Furthermore, the present system may also be used in areas requiring weather sensors, area surveillance, telemetry relay, and telecommunications.

BRIEF DESCRIPTION OF THE DRAWINGS

The various features and advantages of the present invention may be more readily understood with reference to the following detailed description taken in conjunction with the accompanying drawing figures, wherein like reference numerals designate like structural elements, and in which.

DETAILED DESCRIPTION

Figure 1:
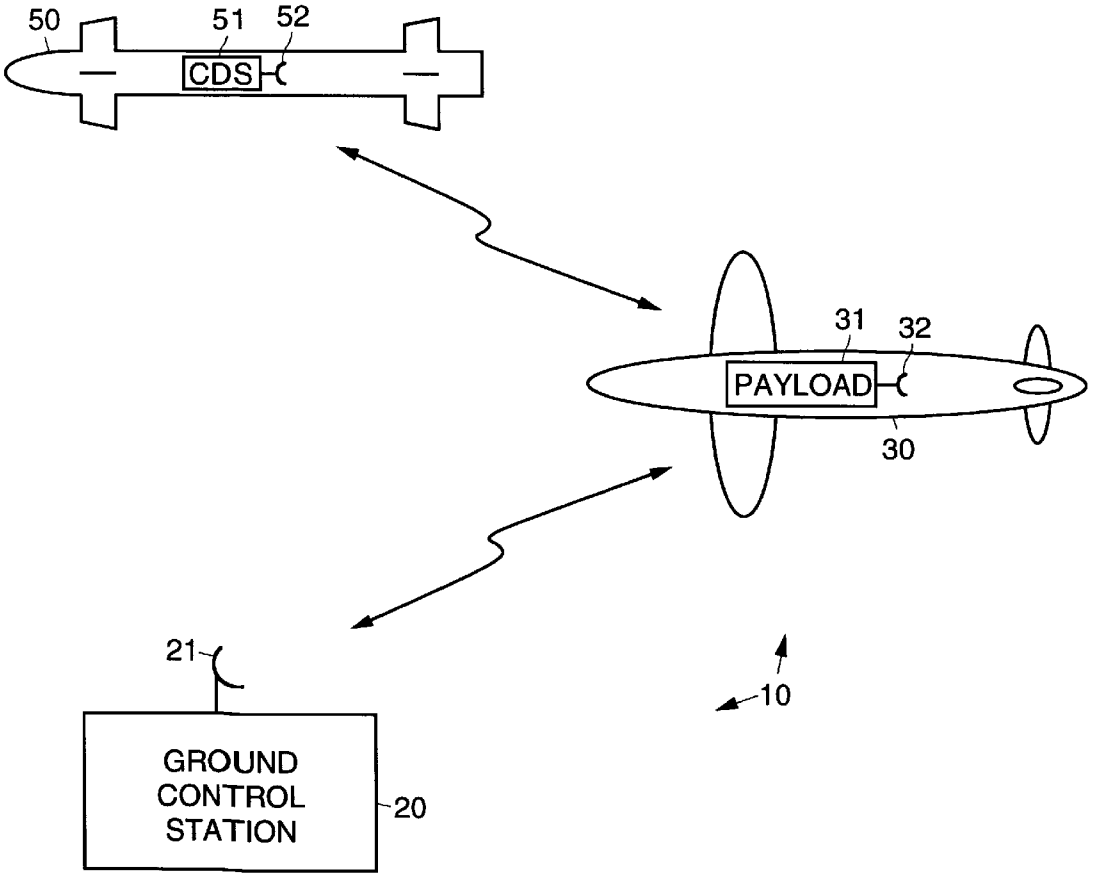
FIG. 1 illustrates an architecture of an exemplary space lift range system in accordance with the principles of the present invention.

Referring to the drawing figures, FIG. 1 illustrates an architecture of an exemplary space lift range system 10 in accordance with the principles of the present invention. The space lift range system 10 comprises a ground control station 20 that communicates and controls one or more unmanned airborne vehicles 30 or airborne payload platforms 30 that in turn communicate with or track a space lift vehicle 50, such as a rocket, for example.

The ground control station 20 provides for communication with and control of the one or more unmanned airborne vehicles 30 and is integrated using commercially available components. The ground control station provides an interface for user communications with the space lift vehicle via the airborne vehicles. Communication between the ground control station 20 and the one or more unmanned airborne vehicles 30 is illustrated by means of an antenna 21 in FIG. 1).

The a space lift vehicle 50 includes a guidance and control, health and status telemetry, and command destruct system (CDS) 51 that communicates with the unmanned airborne vehicle 30 by way of a communication system 52 (illustrated by means of an antenna 52 in FIG. 1). The space lift vehicle 50 may be launched along a flight path that is not constrained by the physical location of the ground control station 20, or of a satellite used in a conventional space-based system.

Figure 2:
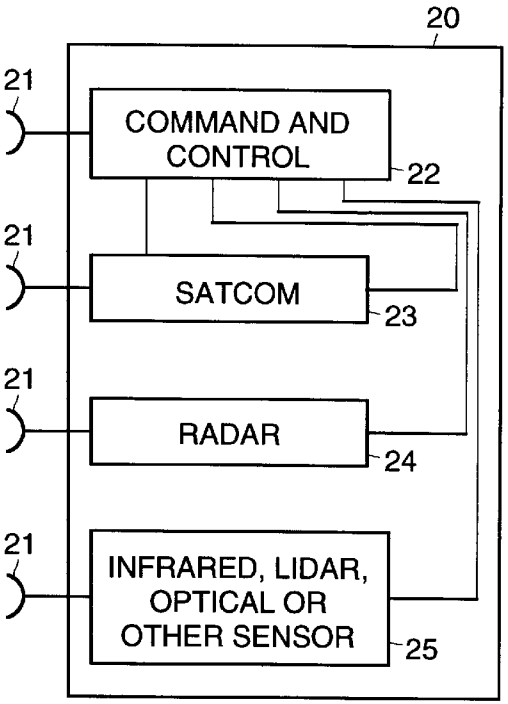
FIG. 2 illustrates details of an exemplary ground control station of the system of FIG. 1.

FIG. 2 illustrates details of an exemplary ground control station 20 of the system 10 of FIG. 1. The exemplary ground control station 20 comprises a command and control system 22, a satellite communication (SATCOM) system 23, a radar processing system 24, and a sensor processing system 25, each of which communicate to the user via user interface and to the unmanned vehicle by way of a communication system 21, such as is generally shown as an antenna 21.

The command and control system 22 functions to provide for commanding of the unmanned airborne vehicle to control the altitude and route of flight as well as the functions of the command and sensor equipment aboard the airborne vehicle. The command and control system 22 may be a commercially available system manufactured by Aurora Flight Sciences, for example.

The satellite communication system 23 typically functions to communicate with a satellite (not shown) that may be used to communicate with the space lift vehicle 50. The satellite communication system 23 used in the ground control station 20 may be a commercially available system manufactured by Aurora Flight Sciences, for example.

The radar system 24 functions to track the space lift vehicle 50 during its flight and track the unmanned airborne vehicle 30 during its flight. The radar system 24 may be a commercially available system manufactured by Ericsson Microwave, for example.

The sensor processing system 25 functions to convert sensor data into user defined functionality. The sensor processing system 25 may be constructed using commercially available components manufactured by TriStar Array Systems, for example.

Figure 3:
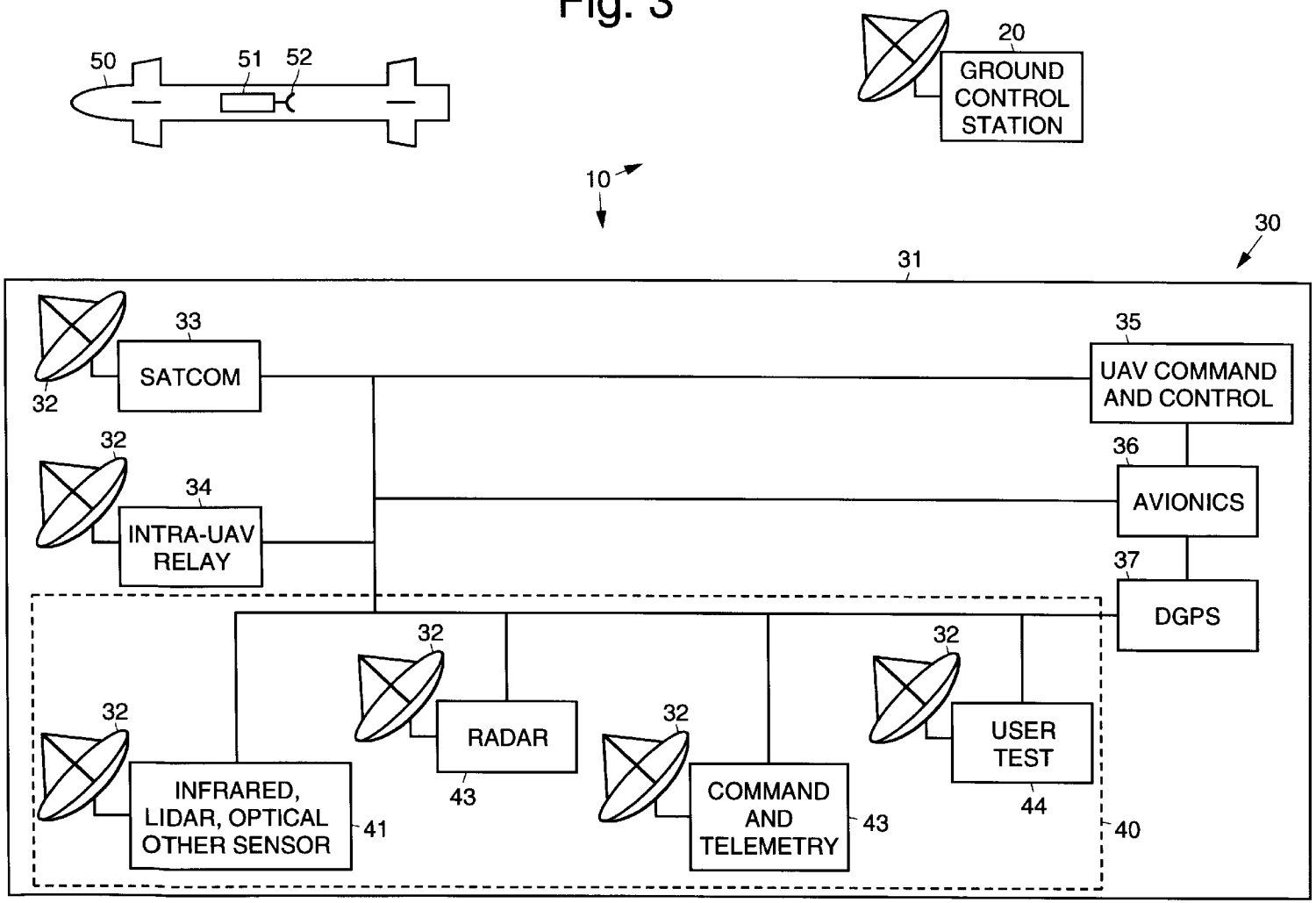
FIG. 3 illustrates details of an exemplary unmanned airborne vehicle used in the system of FIG. 1.

FIG. 3 illustrates details of an exemplary unmanned airborne vehicle 30 used in the system of FIG. 1. The exemplary unmanned airborne vehicle 30 comprises a conventional airframe, such as one designed and built by the assignee of the present invention. Alternatively, the airframe of the unmanned airborne vehicle 30 may be procured from other commercial sources, including Aurora Flight Sciences, and AeroVironment, for example.

The unmanned airborne vehicle 30 is typically designed for operational use at altitudes between about 15 and 30 kilometers. This is achieved by the aircraft structure being constructed from lightweight composite materials. A high aspect ratio wing also increases range by minimizing induced drag. To reduce fuel consumption, The aircraft may be powered by efficient piston engines. 4-Cylinder, fuel-injected engines are turbocharged in three stages for operation in thin air at high altitudes. The unmanned airborne vehicle 30 is also designed to provide airborne operation for days, weeks, or longer, depending upon mission requirements. This is achieved by selecting a payload size and propulsion methodology (electric for example) that meets mission duration requirements.

The unmanned airborne vehicle 30 includes a payload 31 (also shown in FIG. 1) that is integrated using commercially available components having a common command and control interface. The payload 31 communicates with the ground control station 20 and the space lift vehicle 50 using various systems that will be described in more detail below. Communication is achieved using a variety of communication systems 32 (illustrated by means of a antenna 32 in FIG. 1).

The unmanned airborne vehicle 30 includes a number of systems that have heretofore been used on an unmanned airborne vehicle for other purposes. These systems include a satellite communication (SATCOM) system 33, an intra UAV relay 34, a UAV command and control system 35, an avionics system 36, and a differential global positioning system (DGPS) 37.

The satellite communication system 33 provides a communication link or relay between the satellite communication system 23 located in the control station 20 and the satellite (not shown) that is in turn used to communicate with the space lift vehicle 50. The satellite communication system 33 employed in the unmanned airborne vehicle 30 may be a commercially available system manufactured by Rockwell Collins, for example.

The intra UAV relay 34 is a low bandwidth (bandwidth constricted) communications link that is used to communicate between several space lift vehicles 50. The intra UAV relay 34 may be a commercially available system manufactured by Aurora Flight Sciences, for example.

The avionics system 36 is a system that provides flight control input and status such as airspeed, altitude, location, and attitude. The avionics system 36 may be a commercially available system manufactured by Aurora Flight Sciences, for example.

The differential global positioning system (DGPS) 37 is a system that processes timing signals received from the global positioning system (GPS) satellite system in order to determine accurate location and altitude. The digital global positioning system 37 may be a commercially available system manufactured by Orbital Sciences Corp, for example.

The design and operation of each of the above-described conventional systems used in the unmanned airborne vehicle 30 are generally well-understood by those skilled in the art. The design and operation of the remaining systems that implement the present invention are also generally well-understood by those skilled in the art.

The unmanned airborne vehicle 30 includes one or more additional systems (which may be used alone or in combination) that implement the space lift range system 10 in accordance with the present invention. These systems include one or more sensor systems 41, a radar system 42, a telemetry and command system 43, and a user test system 44. The sensor systems 41, radar system 42, command and telemetry system 43, and user test system 44 have not heretofore been employed in an unmanned airborne vehicle 30 to implement a space lift range system 10.

The sensor systems 41 may include an infrared, LIDAR, optical, or other sensor 36. The infrared sensor 36 may be a commercially available infrared sensor 36 manufactured by Hughes Space and Communications Company, for example. The LIDAR sensor 36 may be a commercially available LIDAR sensor 36 NASA Multi-center Airborne Coherent Atmospheric Wind Sensor, for example. The optical sensor 36 may be a commercially available optical sensor 36 manufactured by Instro Precision Limited, for example.

Information derived onboard the unmanned airborne vehicle 30 using the infrared, LIDAR, optical, or other sensor 36 is relayed via the command and telemetry system 43 to the ground control station 20.

The telemetry and command system 43 is a system that receives telemetry from the space lift vehicle and transmits commands to the space lift vehicle. The telemetry and command system 43 may be a commercially available command and telemetry system 43 manufactured by Cincinnati Electronics, for example. The command and telemetry system 43 may be used to communicate user mission package simulation data to and from the user test system 44.

The radar system 42 functions to track the space lift vehicle 50 during its flight. The radar system 42 may be a multiple object tracking radar system 42, for example 30. Positional information derived from the multiple object tracking radar 35 onboard the unmanned airborne vehicle 30 is relayed to the control system 20 via the command and telemetry system 43. The radar system 42 may be a commercially available system manufactured by Ericsson Microwave, for example. Radar signals generated by the radar system 42 are relayed to the ground control station 20 for processing.

The user test system 44 is a system that allows a user to test specific aspects relating to the space lift vehicle 50 and which may change from mission to mission.

The payload bay in the unmanned airborne vehicle 30 is designed to provide for interchangeability of components, without additional integration costs. This makes the mission of the unmanned airborne vehicle 30 as flexible as possible with minimum cost to a user. A published payload interface to the unmanned airborne vehicle 30 permits users to fly LEO packages at high altitude for testing purposes further extending the utility of the unmanned airborne vehicle 30.

A variety of equipment packages to support various missions may be installed in the unmanned airborne vehicle 30 to provide the numerous range capabilities. FIG. 3 illustrates certain of these capabilities. Different sensor systems 41 may be employed for different flight scenarios or operating conditions. The use of the radar system 43 permits tracking of the space lift vehicle 50 beyond the normal range of the radar system 24 in the ground control station 20. This readily permits long range extended flight plans to be implemented to test the space lift vehicle 50.

Thus, a space lift system employing an unmanned airborne vehicle that is used to implement a mobile space lift range has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A system for assisting the launch of a vehicle into space, comprising:

an unmanned airborne vehicle that flies a controllable flight plan and that comprises a command and telemetry system for communicating with and commanding the vehicle that is to be launched into space; and a ground control station that communicates with and controls the unmanned airborne vehicle and that communicates with and controls the vehicle that is to be launched into space by way of the unmanned airborne vehicle.

2. The system recited in claim 1 wherein the command and telemetry system comprises a system that allows users to receive telemetry from the vehicle that is to be launched into space and to transmit commands to that vehicle.

3. The system recited in claim 1 further comprising a sensor system.

4. The system recited in claim 3 wherein the sensor system comprises an infrared sensor system.

5. The system recited in claim 3 wherein the sensor system comprises a LIDAR sensor system.

6. The system recited in claim 3 wherein the sensor system comprises an optical sensor system.

7. The system recited in claim 1 further comprising a radar system.

8. The system recited in claim 7 wherein the radar system comprises a multiple object tracking radar system.

9. The system recited in claim 1 further comprising a user test system.

10. The system recited in claim 9 wherein the user test system comprises a system for testing specific aspects of the vehicle that is to be launched into space.

11. The system recited in claim 1 wherein the command and telemetry system communicates user mission package simulation data to and from the user test system.

12. The system recited in claim 1 wherein the vehicle that is to be launched into space comprises a rocket.

13. The system recited in claim 1 further comprising a plurality of unmanned airborne vehicles.

* * * * *